United States Patent [19]

Blaser et al.

[11] 4,055,484

[45] Oct. 25, 1977

[54] ELUTRIATION IN A FLUID COKING PROCESS

[75] Inventors: Don E. Blaser, Randolph, N.J.; Byron V. Molstedt, Baton Rouge, La.

[73] Assignee: Exxon Research & Engineering Co., Linden, N.J.

[21] Appl. No.: 686,634

[22] Filed: May 14, 1976

[51] Int. Cl.[2] ..... C10G 9/32

[52] U.S. Cl. ..... 208/127; 48/63; 48/206

[58] Field of Search ..... 208/127

[56] References Cited

U.S. PATENT DOCUMENTS

| | | | |
|---|---|---|---|
| 2,734,853 | 2/1956 | Smith et al. | 208/127 |
| 2,906,703 | 9/1959 | Valle | 208/127 |
| 3,661,543 | 5/1972 | Saxton | 208/127 |
| 3,752,658 | 8/1973 | Blaser | 208/127 |
| 3,853,744 | 12/1974 | Lahn | 208/127 |

*Primary Examiner*—Herbert Levine
*Attorney, Agent, or Firm*—Marthe L. Gibbons

[57] ABSTRACT

In a fluid coking process, a gas containing coke particles is elutriated in a riser portion of a vessel to remove selectively the larger coke particles. The elutriated gas flows into a bed of solids positioned in the upper portion of the vessel.

6 Claims, 6 Drawing Figures

FIGURE I

ELUTRIATION IN A FLUID COKING PROCESS

BACKGROUND OF THE INVENTION

1. Field of the Invention

This invention relates to an improvement in a fluid coking process. It particularly relates to an improvement in the elutriation of the circulating coke. More particularly, it relates to an improvement in the elutriation of coke in an integrated fluid coking and coke gasification process.

2. Description of the Prior Art

Integrated fluid coking and gasification processes are known. See, for example, U.S. Pat. Nos. 3,661,543, 3,816,084; 3,702,516; and 3,779,900, the teachings of which are hereby incorporated by reference. In such integrated processes, at least a portion of the coke product is gasified by reaction with steam and an oxygen-containing gas to produce a hydrogen-containing fuel gas. The hot gasifier effluent including entrained solids is introduced into a heating zone to provide at least a portion of the heat required to heat relatively colder coke particles in a fluidized bed of coke.

In the conventional fluid coking process, such as disclosed in U.S. Pat. No. 2,881,130, the teachings of which are hereby incorporated by reference, a stream of coke is circulated to a burner in which a portion of the coke is burned to provide the heat requirements of the process. Although a large number of coke agglomerates are produced in the coking reactor, some of these agglomerates disintegrate in the burner and a large portion of agglomerates is withdrawn with the product coke. Therefore, in the conventional fluid coking process, the concentration of agglomerates in the system remains relatively low. In contrast, in the integrated fluid coking and coke gasification process, the rate of withdrawal of product coke is low, and therefore the accumulation of agglomerates becomes a problem. Although there is a substantial increase in the deagglomeration process due to the gasification of a large portion of the gross coke, it is not adequate to purge the agglomerates from the circulating coke. The problem of removing enough agglomerates from the system while maintaining a particle size distribution suitable for good fluidization in the coke circulation lines had to be overcome. One way of improving the agglomerate withdrawal is to provide an improved method of elutriation of the coarse particles. Another problem that occurs in the integrated fluid coking and coke gasification process is the distribution of the hot, corrosive, gasification zone gaseous effluent which contains some entrained coke, into the heating zone bed. To reduce the temperature of the hot gasifier effluent, it had been proposed to mix a colder stream of coke with the hot gas (see, for example, U.S. Pat. Nos. 3,702,516 and 3,779,900). Although the proposed methods could reduce the temperature of the gas, these methods still did not solve the problem of elutriating the coke particles from the gasifier effluent and of operating at normal loading and velocity while maintaining a velocity where slugging would not be a problem during turndown. Another problem which had to be solved was a method whereby a rapid rise in temperature in the riser of the heater would not occur when the quench coke circulation stops.

It has now been found that these difficulties can be overcome by the process of the present invention whereby the quenched gasification effluent is elutriated in the heating vessel riser prior to introducing the solids-containing gaseous stream into the main heat exchange zone of the heating vessel.

SUMMARY OF THE INVENTION

In accordance with the invention, there is provided a coking process comprising the steps of:

a. contacting a carbonaceous material under fluid coking conditions in a coking zone containing a first bed of fluidized solids to form coke, said coke depositing on said fluidized solids;

b. passing a portion of said solids with the coke deposition thereon to a vessel comprising an upper portion containing a second bed of fluidized solids and a lower elongated portion, the improvement which comprises:

c. introducing into said lower elongated portion a relatively high velocity gaseous stream containing solids through a conduit having an outlet of smaller internal diameter than the internal diameter of said lower elongated portion;

d. reducing the velocity of said gaseous stream by upwardly flowing said stream from said outlet to said upper portion of said vessel, whereby the larger particles of the solids are selectively removed by gravitational forces from said gaseous stream and form a dense bed below said outlet of said gaseous stream in said lower portion;

e. maintaining said bed of said lower portion fluidized by passage of a fluidizing gas therethrough; and f. continuously re-entraining at least a portion of the solids from said lower bed into said gaseous stream.

DESCRIPTION OF THE PREFERRED EMBODIMENT

The elutriation process of the invention is applicable to a fluid coking process in which solids are circulated from the coker to at least a second vessel containing a fluidized bed of solids. The second vessel may be a heating vessel (i.e. combustion vessel or heat exchange vessel) or a gasification vessel. The elutriation process is particularly well suited to elutriate solids in an integrated fluid coking and coke gasification process.

The preferred embodiment will be described with reference to FIGS. 1 and 2.

Figure 1:
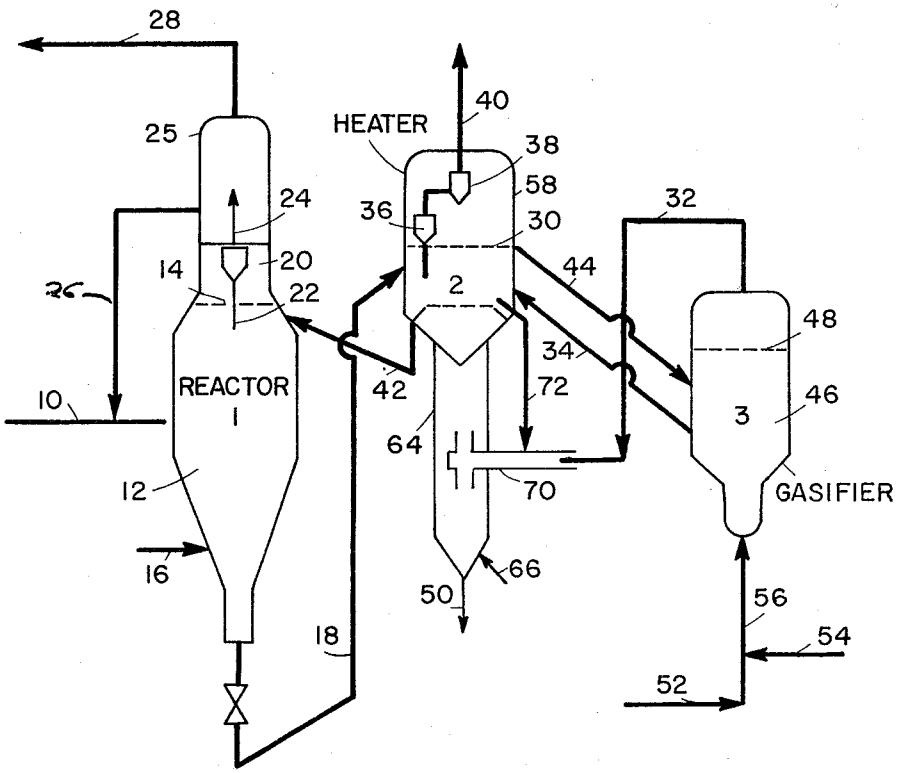
FIG. 1 is a schematic flow plan of one embodiment of the invention.

Referring to FIG. 1, a carbonaceous material having a Conradson carbon residue of about 22 weight percent, such as heavy residuum having a boiling point (at atmospheric pressure) of about 1,050° F.+ is passed by line 10 into a coking zone 12 in which is maintained a fluidized bed of solids (e.g. coke particles of 40 to 1000 microns in size) having an upper level indicated at 14. Carbonaceous feeds suitable for the present invention include heavy hydrocarbonaceous oils; heavy and reduced petroleum crudes; petroleum atmospheric distillation bottoms; petroleum vacuum distillation bottoms; pitch, asphalt, bitumen, other heavy hydrocarbon residues; coal; coal slurry; liquid products derived from coal liquefaction processes, and mixtures thereof. Typically such feeds have an API gravity of about minus 10° to about +20° and a Conradson carbon residue of at least 5 weight percent, generally from about 5 to about 50 weight percent, preferably above about 7 weight percent (as to Conradson carbon residue, see ASTM test D-189-65). A fluidizing gas, e.g. steam, is admitted at the base of coking reactor 1 through line 16 in an amount sufficient to obtain superficial fluidizing gas velocity in the range of 0.5 to 5 feet per second. Coke at a temperature above the coking temperature, for example, at a temperature from about 100° to 800° F. in excess of the actual operating temperature of the coking zone is admitted to reactor 1 by line 42 in an amount sufficient to maintain the coking temperature in the range of about 850° to about 1400° F. The pressure in the coking zone is maintained in the range of about 5 to about 150 pounds per square inch guage (psig), preferably in the range of about 5 to about 45 psig. The lower portion of the coking reactor serves as a stripping zone to remove occluded hydrocarbons from the coke. A stream of coke is withdrawn from the stripping zone by line 18 and circulated to heater 2. Conversion products are passed through cyclone 20 to remove entrained solids which are returned to the coking zone through dipleg 22. The vapors leave the cyclone through line 24 and pass into a scrubber 25 mounted on the coking reactor. If desired, a stream of heavy material condensed in the scrubber may be recycled to the coking reactor via line 26. The coker conversion products are removed from scrubber 25 via line 28 for fractionation in a conventional manner. In heater 2, stripped coke from coking reactor 1 (commonly called cold coke) is introduced by line 18 to a fluid bed of hot coke having an upper level indicated at 30. The bed is partially heated by passing a hotter fuel gas into the heater by line 32. Supplementary heat is supplied to the heater by coke circulating in line 34. The gaseous effluent of the heater including entrained solids passes through a cyclone which may be a first cyclone 36 and a second cyclone 38 wherein separation of the larger entrained solids occurs. The separated larger solids are returned to the heater bed via the respective cyclone diplegs. The heated gaseous effluent is removed from heater 2 via line 40.

Hot coke is removed from the fluidized bed in heater 2 and recycled to coking reactor by line 42 to supply heat thereto. Another portion of coke is removed from heater 2 and passed by line 44 to a gasification zone 46 in gasifier 3 in which is maintained a bed of fluidized coke having a level indicated at 48. If desired, a purge stream of coke may be removed from heater 2 by line 50.

The gasification zone is maintained at a temperature ranging from about 1,500° to about 2,000° F., and a pressure ranging from about 5 to about 150 psig, preferably at a pressure ranging from about 10 to 60 psig, and more preferably at a pressure ranging from about 25 to about 45 psig. Steam by line 52 and an oxygen-containing gas such as air, commercial oxygen or air enriched with oxygen by line 54 are passed via line 56 into gasifier 3. Reaction of the coke particles in the gasification zone with the steam and the oxygen-containing gas produces a hydrogen and carbon monoxide-containing fuel gas. The gasifier product fuel gas, which may further contain some entrained solids, is removed overhead from the gasifier 3 by line 32 and introduced into heater 2 to provide a portion of the required heat as previously described.

Returning to heater 2, there is shown (see details in FIG. 2) a heater comprising an upper enlarged portion 58, a perforated grid 60 positioned in the lower part of the upper heater portion 58, a conical portion 62 and a lower heater portion 64 which is an elongated riser portion. The riser portion 64 comprises at its bottom end inlet means 66 for admitting a fluidizing gas. In riser 64 is positioned a right angle bend 68 which is operatively connected to a gas inlet conduit 70 which projects into the wall of riser 64. Conduit 72 is provided to carry solids from upper heater bed 30 to gas inlet conduit 70 by inlet 74 which is located in the portion of conduit 70 which is outside the heater. Gas from the gasifier, for example, at about 1,600° to 1,800° F. in line 70 is contacted with relatively colder coke (quench coke) from heater bed 30 at about 1,100° to 1,250° F. flowing through line 72 into line 70. The coke and gas come to a temperature of about 1,150° to 1,300° F. The resulting solids-containing gaseous stream enters the heater vessel at a right angle to the vertical wall of the riser in the embodiment shown in FIGS. 1 and 2 and flow out gas outlet 80 as a gas jet, indicated in FIG. 2 as lines 73 and 75 which define a high velocity gas jet zone designated J. The cross sectional diameter of outlet 80 (note this is actually the gas inlet into the riser but an outlet with reference to conduit 70) is smaller than the cross sectional diameter of riser 64. The gas flows upwardly from outlet 80 and into the upper portion of the vessel where it acts as fluidizing gas for the upper heater bed. Since the gas flows from a smaller internal diameter outlet into a larger space, the gas expands. As the gas expands and flows upwardly, its velocity is reduced. A portion of the coke particles fall out of the gas jet by gravitational forces into a stagnant zone indicated at S and then into a lower portion of the riser where they form a fluidized dense bed 76 having a level indicated at 78. The bed level is maintained at a point which will recirculate coke back into the gas jet. In this embodiment, the bed must be high enough to provide the static head to force the coke particles into the gas jet through the lower orifice. Bed level 78 is below gas outlet 80. The static head between bed level 78 and a lower nozzle 82 causes circulation of coke into the gas stream. The rapid circulation of coke into and out of the gas stream allows the fine coke to be carried through grid 60.

The coarser particles remain in fluid bed 76. The very high reflux of coke into the stream and the fact that the larger particles fall out of the gas jet faster than smaller particles cause the bed to be filled with large particles. The size of the lower heater bed is determined solely by the coke draw-off rate for any given particle size distribution in the unit and agglomerate formation rate. A high draw-off rate results in more fine coke in the lower bed as more coke is required to fill the fluid bed and the quantity of coarse coke is limited. The low draw-off rate results in a coarse product coke containing the agglomerates as the fines are entrained to the upper heater bed.

As a specific illustration of the expansion of the gas stream in the riser and the resulting reduction in velocity of the stream, if alpha is the half angle of the gas jet, $D_1$ the gas inlet diameter, $D_2$ the diameter of the jet at H, wherein H is the height above the gas inlet, $A_1$ is the area of the inlet and $A_2$ the area of the jet at H, and where V is the velocity of the gas per unit time, then according to the equation $D_2 = D_1 + 2H$ tan angle alpha and at constant gas volume $$\frac{A_1}{A_2}\ \frac{V_2}{V_1} = \frac{D_1^2}{D_2^2} = \frac{D^2}{(D_1 + 2H \tan \text{alpha})^2},$$

assuming that angle alpha is 7°, for $H=20$ and $D_1=5$ feet and $V_1$ is 60 feet per second, the $V_2$, the velocity per unit time at $D_2$ would be about 15.27 feet per second.

The dense bed in the bottom of the heater also acts as a reservoir of colder coke. If the quench coke circulation stops, the coke must be heated, thus allowing time for action by the operators or emergency instrumentation before temperatures are reached which might damage equipment. As example, suitable velocities for the gas stream carried in line 70 include a range from about 50 to about 120 feet per second. The superficial velocity of fluidizing gas introduced by line 66 into the bottom of riser 64 may range from about 0.1 to about 0.5 feet per second or higher. This velocity is not critical to the invention as long as it is higher than the minimum fluidizing velocity of the particles in this bed. The velocity of the gas jet flowing upwardly in the riser, for elutriation, may range from about 5 to about 25 feet per second, typically from about 7 to 20 feet per second, for fluid coke. The gaseous stream resulting from the mixture of hot gas and quench coke is suitably introduced into the fluidizing gas stream in the riser at a velocity ranging from about 30 to about 80 feet per second.

Figure 2:
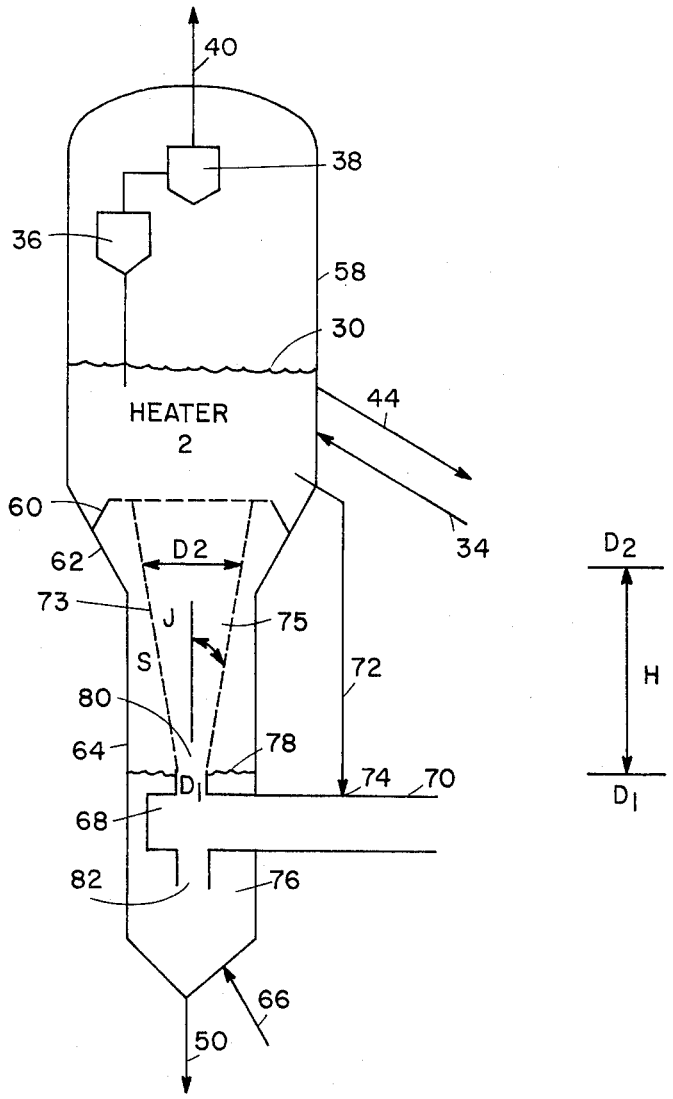
FIG. 2 shows a portion of FIG. 1 in more details.
Figure 3:
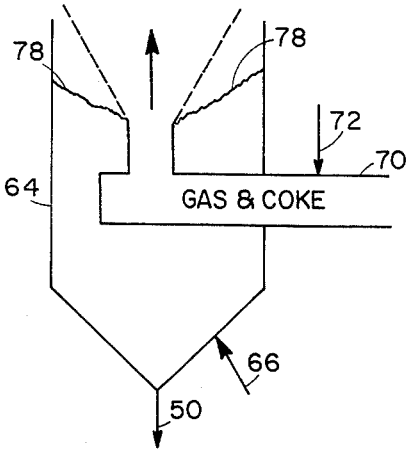
FIG. 3 shows a second embodiment of the invention.

In FIG. 3 is shown an alternative for the embodiment of FIG. 2. Instead of a cross inlet bend 68 a T-bend is provided.

Figure 4:
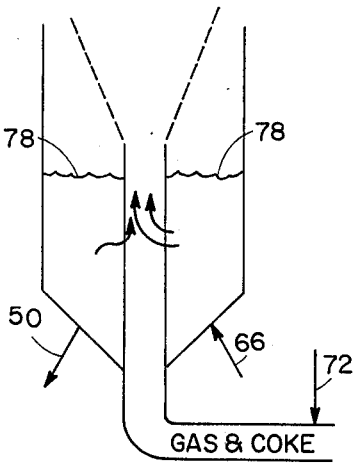
FIG. 4 shows a third embodiment of the invention.

In FIG. 4 is shown another alternative embodiment for the embodiment of FIG. 2. A bottom gas inlet is provided. The gas inlet has holes in the side. Coke recirculates through the holes into the main gas stream in the same manner as it flows into the bottom of the cross inlet of the preferred embodiment which is shown in FIG. 2.

Figure 5:
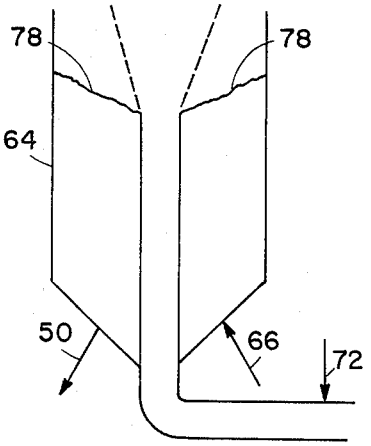
FIG. 5 shows a fourth embodiment of the invention.

FIG. 5 is similar to the embodiment of FIG. 4 except that there are no holes in the side of the gas pipe.

Figure 6:
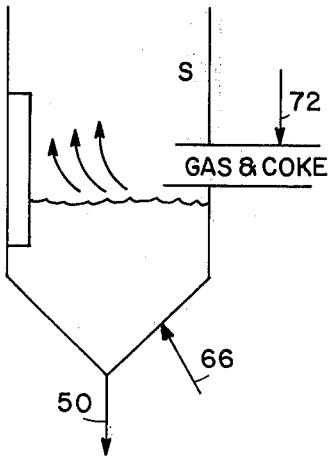
FIG. 6 shows a fifth embodiment of the invention.

FIG. 6 is another alternative for the embodiment of FIG. 2. There is little or no internal extension of gas pipe. Instead of a T for errosion protection, a wear plate is installed on the shell opposite of the gas and coke inlet. The bed level stays close to the gas inlet, and coke is re-entrained from the lower dense bed into the gas stream by the gas velocity across the lower bed top.

What is claimed is:

1. In an integrated coking and gasification process which comprises the steps of:

a. reacting a carbonaceous material having a Conradson carbon content of at least 5 weight percent in a coking zone containing a bed of fluidized solids maintained under fluid coking conditions to form coke, said coke depositing on said fluidized solids;

b. introducing a portion of said solids with the coke deposition thereon into a heating vessel comprising an elongated lower portion and an upper enlarged portion containing a fluidized bed of solids maintained at a greater temperature than the temperature of said coking zone, to heat said portion of solids;

c. recycling a first portion of heated solids from said heating vessel to said coking zone;

d. introducing a second portion of heated solids from said heating vessel to a fluidized bed gasification zone;

e. reacting said second portion of heated solids in said gasification zone with steam and an oxygen-containing gas to produce a hydrogen-containing gaseous stream, f. removing said hydrogen-containing gaseous stream including entrained solids from said gasification zone;

g. adding a portion of solids to said hydrogen-containing gas of step (f), the improvement which comprises:

h. introducing into said lower elongated portion the solids-containing gaseous stream resulting from step (g), said gaseous stream being introduced as a relatively high velocity gaseous stream through a conduit having an outlet of smaller internal diameter than the internal diameter of said elongated lower portion;

i. reducing the velocity of said gaseous stream by upwardly flowing said stream from said outlet to said upper portion of said heating vessel, whereby the larger particles of the solids are selectively removed by gravitational forces from said gaseous stream and form a dense bed below said outlet of said gaseous stream in said lower heating vessel portion;

j. maintaining the bed in said lower heater portion fluidized by passage of a fluidizing gas therethrough, and k. continuously re-entraining at least a portion of the solids from said lower heater bed into said gaseous stream.

2. The process of claim 1 wherein the inlet velocity of said solids-containing stream into said elongated lower portion of the heating vessel ranges from 30 to 80 feet per second.

3. The process of claim 1 wherein the solids in said gaseous stream are fluid coke particles and wherein the gaseous stream of step (i) flows upwardly at a velocity ranging from about 5 to 25 feet per second.

4. The process of claim 1 wherein the added portion of solids of step (g) is a portion of solids removed from said coking zone.

5. The process of claim 1 wherein said added portion of solids of step (g) is a portion of solids removed from the fluidized bed of solids positioned in the upper enlarged portion of the heating vessel.

6. The process of claim 1 wherein said added portion of solids of step (g) is colder than the hydrogen-containing gas to which it is added, thereby quenching said gas.

* * * * *